US006166353A

United States Patent [19]

Senneville et al.

[11] Patent Number: 6,166,353

[45] Date of Patent: Dec. 26, 2000

[54] FREE-STANDING WARMER DRAWER

[75] Inventors: François Senneville, Repentigny; Serge Laprade, Berthierville; Gilbert Archambault, Repentigny; Stéphane Labadens, St-Gérard, all of Canada

[73] Assignee: White Consolidated Industries, Inc., Cleveland, Ohio

[21] Appl. No.: 08/916,650

[22] Filed: Aug. 22, 1997

[51] Int. Cl.[7] ..... F24C 15/08; F24C 7/00

[52] U.S. Cl. ..... 219/385; 219/392; 219/394; 99/357; 126/275 E; 126/273 R; 312/236; 312/330.1; 312/270.3

[58] Field of Search ..... 219/385, 393, 219/394, 398, 214, 218; 99/357, 386, 443 R, 450, 483; 312/236, 198, 199, 351.4, 351.5, 9.3, 330.1; 126/339, 273 R, 275 R, 275 E

[56] References Cited

U.S. PATENT DOCUMENTS

| | | | |
|---|---|---|---|
| 273,730 | 3/1883 | Harlow . | |
| 736,509 | 8/1903 | Eimer | 219/392 |
| 1,588,084 | 7/1926 | Apfel . | |
| 1,679,052 | 7/1928 | Page | 126/339 |
| 1,803,330 | 5/1931 | Johnson | 312/270.3 |
| 2,288,144 | 6/1942 | Sickinger | 126/339 |
| 2,290,572 | 7/1942 | Rakov . | |
| 2,535,379 | 12/1950 | White | 126/339 |
| 2,566,553 | 9/1951 | Cline . | |
| 2,632,434 | 3/1953 | Pearce . | |
| 2,715,898 | 8/1955 | Michaelis et al. . | |
| 2,872,557 | 2/1959 | Thrasher . | |
| 2,942,926 | 6/1960 | Pavelka, Jr. | 312/270.3 |
| 3,057,343 | 1/1962 | Nelson et al. . | |
| 3,161,755 | 12/1964 | Tilus . | |
| 3,176,118 | 3/1965 | Scott . | |
| 3,297,386 | 1/1967 | Stanek et al. | 312/270.3 |
| 3,335,626 | 8/1967 | Smart et al. . | |
| 3,402,281 | 9/1968 | Vonderhaar . | |
| 3,404,258 | 10/1968 | Winkler . | |
| 3,490,823 | 1/1970 | Neu et al. . | |
| 3,598,962 | 8/1971 | Badnaruk . | |
| 3,613,656 | 10/1971 | Henderson . | |
| 3,692,351 | 9/1972 | Christopher et al. . | |
| 3,819,247 | 6/1974 | Evans . | |
| 3,923,037 | 12/1975 | Donato | 99/339 |
| 4,025,299 | 5/1977 | Dubois | 219/521 |
| 4,039,776 | 8/1977 | Roderick . | |

(List continued on next page.)

FOREIGN PATENT DOCUMENTS

| | | | |
|---|---|---|---|
| 2204795 | 6/1998 | Canada . | |
| 4104962 | 8/1992 | Germany . | |
| 92/05951 | 8/1992 | South Africa | 219/392 |
| 766808 | 1/1957 | United Kingdom | 219/391 |

OTHER PUBLICATIONS http://www.vikingrange.com/cooking/biewd.html "Built–in Electric Warming Drawers", Viking Co. Aug. 27, 1999.

hppt://www.thermador.com—Thermador web page with specifications on Warming Drawers, 1998.

*Primary Examiner*—John A. Jeffery

*Attorney, Agent, or Firm*—Pearne & Gordon LLP

[57] ABSTRACT

A free-standing warming appliance includes an outer enclosure and an inner liner which cooperate together to form a heating chamber. A warmer drawer forming a receptacle for precooked food stuffs is selectively inserted into and withdrawn out of the heating chamber. A heating element is secured to the inner liner within the heating chamber to warm the food stuffs within the warmer drawer receptacle. A control panel has an indicator light and infinite switch for controlling the heating element. The control panel is located within the enclosure and covered by a front panel of the warmer drawer so that access to the control components of the control panel is provided only when the warmer drawer is withdrawn from the heating chamber. Oven support members are secured to the outer enclosure to support a cooking appliance, such as a built-in oven, above the free-standing warming appliance. The cooking appliance rests directly on the oven support members of the warming appliance.

13 Claims, 10 Drawing Sheets

U.S. PATENT DOCUMENTS

| | | | |
|---|---|---|---|
| 4,041,277 | 8/1977 | Shumrak et al. . | |
| 4,065,659 | 12/1977 | Yount . | |
| 4,245,615 | 1/1981 | Henderson et al. . | |
| 4,317,025 | 2/1982 | Starnes . | |
| 4,345,143 | 8/1982 | Craig . | |
| 4,444,175 | 4/1984 | Reynolds . | |
| 4,474,107 | 10/1984 | Cothram | 99/352 |
| 4,476,848 | 10/1984 | Protas | 219/392 |
| 4,516,485 | 5/1985 | Miller . | |
| 4,579,402 | 4/1986 | Wenzlick | 312/330 |
| 4,605,840 | 8/1986 | Koopman . | |
| 4,759,341 | 7/1988 | McFarland . | |
| 4,839,502 | 6/1989 | Swanson . | |
| 4,910,386 | 3/1990 | Johnson | 219/385 |
| 5,197,378 | 3/1993 | Scalise . | |
| 5,198,638 | 3/1993 | Massacesi | 219/209 |
| 5,417,148 | 5/1995 | Cavallo . | |
| 5,466,058 | 11/1995 | Chan | 312/111 |
| 5,519,188 | 5/1996 | Yuichi . | |
| 5,619,613 | 4/1997 | Otaki . | |

FREE-STANDING WARMER DRAWER

BACKGROUND OF THE INVENTION

The present invention generally relates to domestic kitchen appliances and, more particularly, to domestic warming appliances having a warmer drawer adapted to receive and maintain cooked hot food at an above-ambient temperature.

Domestic kitchens typically have a cooking or baking appliance, such as a range or a built in oven, which is used to cook food stuffs. It would also be advantageous for domestic kitchens to have a warming or holding appliance, like many commercial kitchens. The warming appliance is used to hold previously cooked food stuffs in a warm or above-ambient condition. The warming appliance holds the food stuffs at a controlled above-ambient temperature so that the food remains hot but is not further cooked because further cooking may degrade the food quality. Warming appliances are distinguished from cooking appliances in that cooking appliances typically operate at cooking temperatures up to 550 degrees Fahrenheit and up while warming appliances typically operate at much lower temperatures such as in the range of 160 to 200 degrees Fahrenheit.

Commercial warming appliances are typically constructed together with the cooking appliances. These combination appliances can be relatively expensive and difficult to install and remove due to their relatively high weight. Most domestic kitchens already have a built-in oven or range which may not need to be replaced. Additionally, domestic kitchens typically have a large number of standard wood storage cabinets which can be utilized to hold a warming appliance. Accordingly, there is a need in the art for a separate or free-standing warming appliance which can be installed in a standard kitchen cabinet. There also exists the need in the art for a warming appliance which is relatively inexpensive, light weight, and easy to install and remove.

BRIEF SUMMARY OF THE INVENTION

The present invention provides a free-standing warming appliance which overcomes at least some of the above-noted problems of the related art. The warming appliance includes an enclosure and a liner. The enclosure has a pair of lateral walls and a top wall disposed between the lateral walls. The liner has a pair of lateral walls inwardly spaced from the enclosure lateral walls and a bottom wall disposed between the liner lateral walls. The enclosure top wall, the liner lateral walls, and the liner bottom wall cooperate to form a heating chamber. A warmer drawer is adapted to be received within and withdrawn from the heating chamber. A heating element is secured to the liner within the heating chamber to warm food stuffs placed within the warmer drawer.

According to another aspect of the present invention, the warming appliance includes a control panel having control components for controlling the heating element. The control panel is located within the enclosure so that access to the control panel is provided only when the warmer drawer is withdrawn from the heating chamber. Preferably, the control panel is located between one of the enclosure lateral walls and one of the liner lateral walls and the warmer drawer includes a front wall which extends between the enclosure lateral walls in front of the control panel.

According to a further aspect of the present invention, the warming appliance includes support members secured to the outer enclosure. A separate cooking appliance, such as a built-in oven, rests above the warming appliance directly on the support members. Therefore, the free-standing warming appliance of the present invention is ideal for use in a domestic kitchen in combination with either a new or existing range or built-in oven.

BRIEF DESCRIPTION OF THE SEVERAL VIEWS OF THE DRAWING

These and further features of the present invention will be apparent with reference to the following description and drawings, wherein.

DETAILED DESCRIPTION OF THE INVENTION

Figure 1:
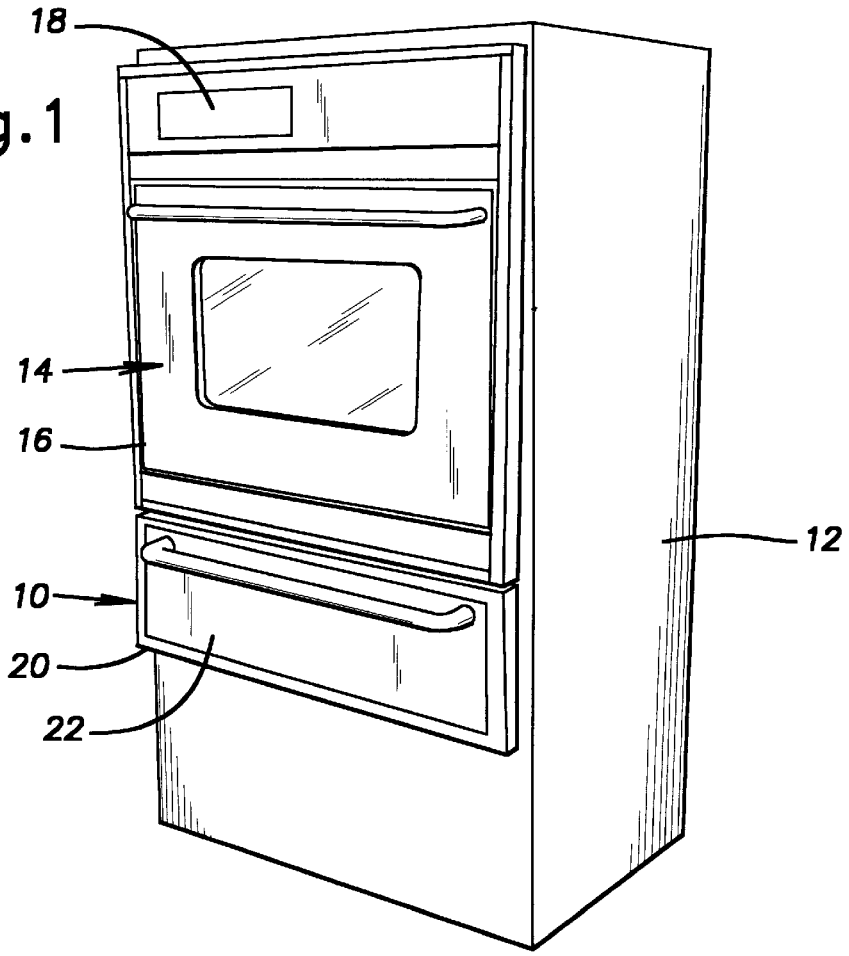
FIG. 1 is a perspective view of a free-standing warming appliance according to the present invention mounted within a standard kitchen cabinet and supporting a built-in oven.
Figure 2:
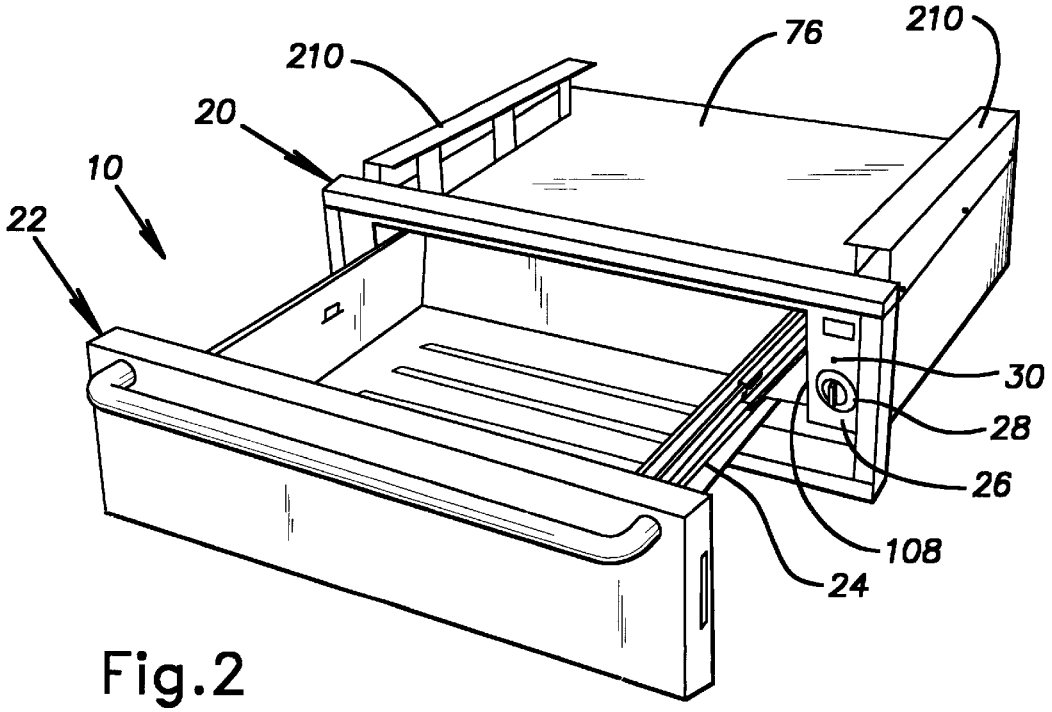
FIG. 2 is a perspective of the warming appliance of FIG. 1 showing a warmer drawer extended from a chassis.

FIGS. 1 and 2 illustrate a free-standing warming appliance or oven 10 according to the present invention. The illustrated warming appliance 10 is located in a standard, wood, kitchen cabinet 12 along with a built-in oven 14. The kitchen cabinet 12 has a generally hollow interior with a front opening in which the oven 14 is located above the warming appliance 10. The oven 14 includes an oven door 16 which is secured so as to permit pivotal movement of the door 16 about its bottom edge. The door 16 provides access to a cooking chamber within the oven 14. An oven control panel 18 is located above the door 16 and includes a plurality of control devices such as, for example dials, switches, buttons, and/or knobs.

The free-standing warming appliance 10 includes a warmer drawer chassis 20 forming a heating chamber therein, a warmer drawer 22 which is selectively inserted into and withdrawn from the heating chamber, and glide assemblies 24 which slidably connect the warmer drawer 22 to the warmer drawer chassis 20. A warmer drawer control panel 26 is located at the front of the warmer drawer chassis 20 behind a portion of the warmer drawer 22 so that it is not visible when the warmer drawer 22 is fully within the heating chamber (best shown in FIG. 1). Access to control components of the control panel 26 is provided when the warmer drawer 22 is withdrawn from the heating chamber (best shown in FIG. 2).

The illustrated control panel 26 has control components including a heater control switch 28 and an associated indicator light 30. Preferably, the heater control switch 28 is rotatably mounted to the control panel 26, and is movable in a push-and-turn fashion to any user-selected position between an off position and a high heat position. More preferably, the heater control switch 28 is an infinite switch wherein the duty cycle (ratio of heater on-time to heater on-time plus heater off-time) varies between zero, when the switch is set to an off position, to one when the switch is set to the high position. As will be described more fully hereafter, rotation of the heater control switch 28 between the various user-selected positions varies the duty cycle of a heating element. It is believed that operation of infinite switches is well known to one skilled in the art and, therefore, will not be further discussed hereafter.

Figure 3:
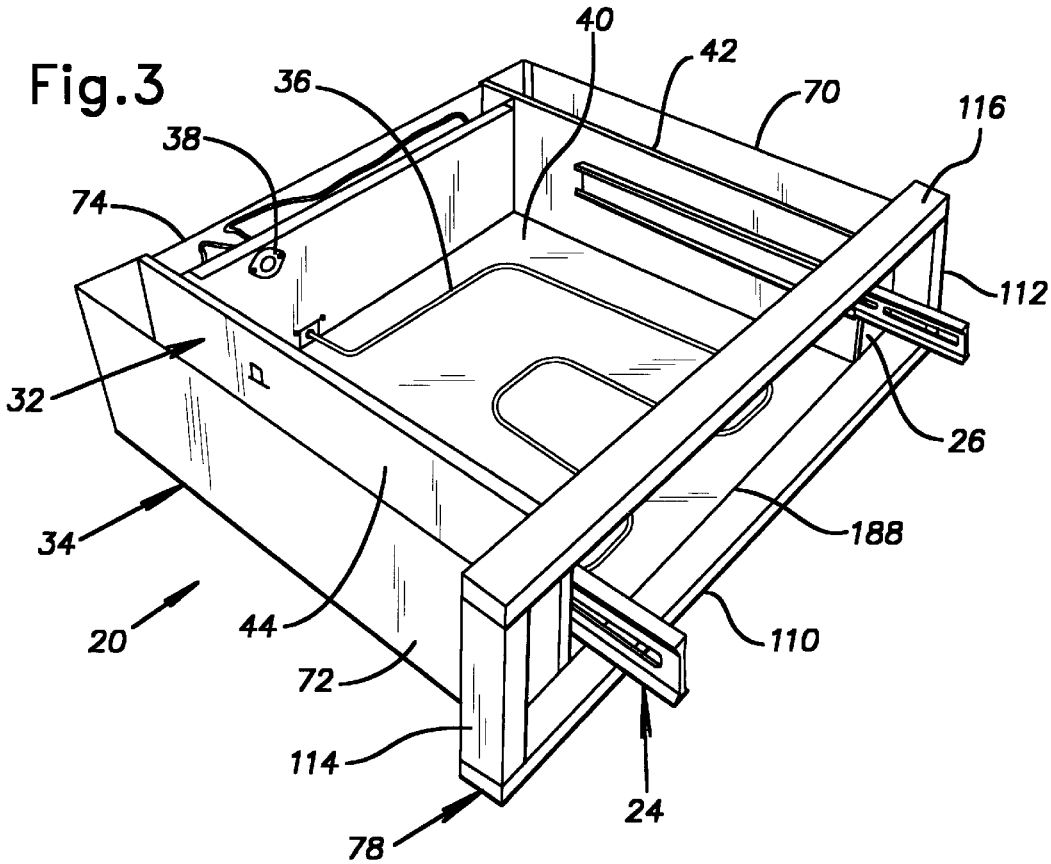
FIG. 3 is a perspective view of the chassis of the warming appliance of FIG. 1 with a top cover removed for clarity.
Figure 4:
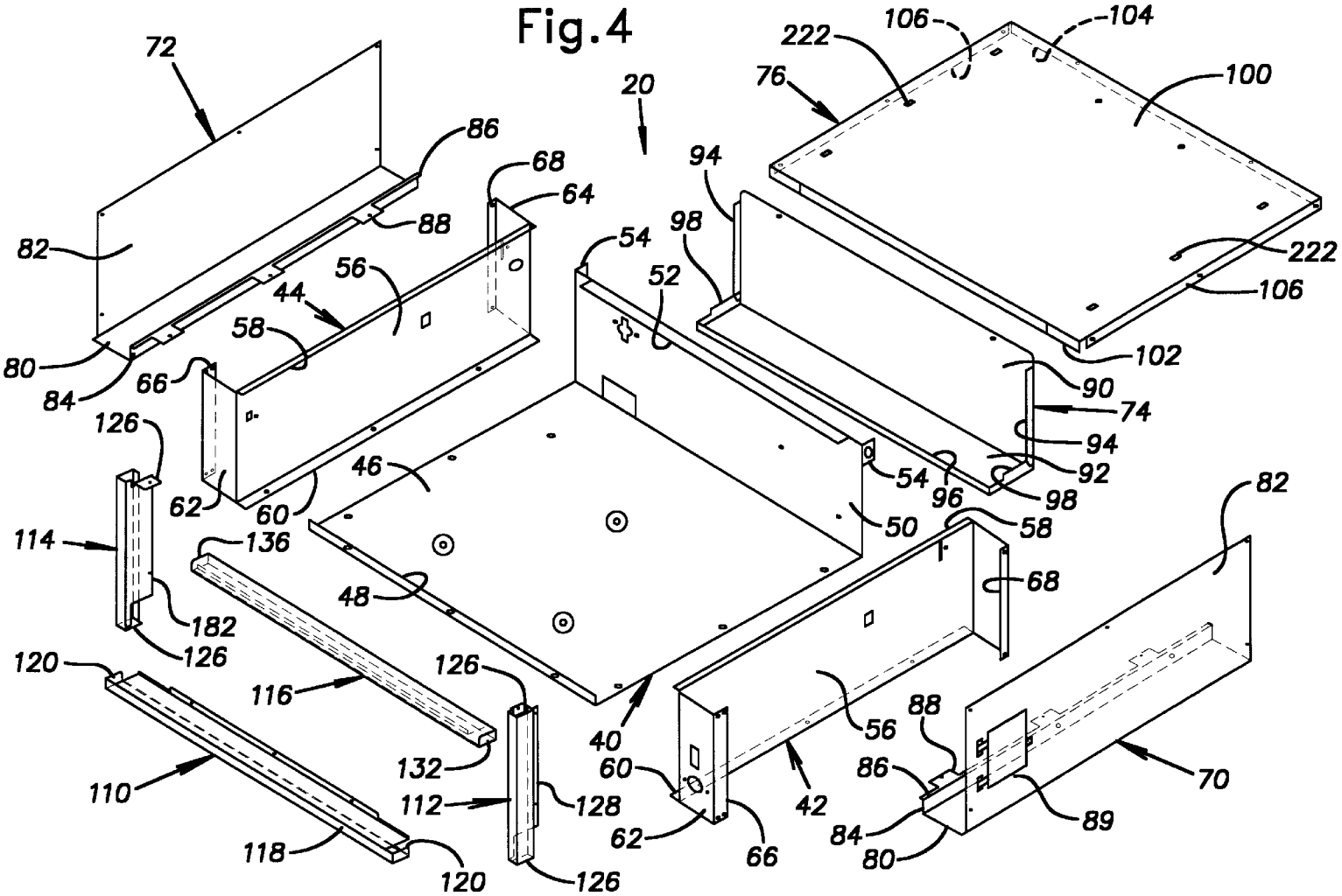
FIG. 4 is an exploded view of the chassis of the warming appliance of FIG. 1.

As best shown in FIGS. 3 and 4, the warmer drawer chassis 20 includes an inner liner 32 which partially defines the heating chamber for the warmer drawer 22, an outer wrapper or enclosure 34 which supports and surrounds the inner liner 32 and partially forms the heating chamber, a heating element 36, and a temperature sensing assembly 38. The inner liner 32 includes a bottom wall or panel 40 and lateral side wall or panels 42, 44. The bottom panel 40 is preferably formed from steel. The side panels 42, 44 are preferably formed from steel with porcelain on exposed surfaces. The porcelain surfaces are preferable over painted surfaces for a number of reasons. These reasons include heat tolerance, resistance to scratches and wear, ease of cleaning, an aesthetic continuity with other surfaces of the warming appliance 10 and of other kitchen appliances such as the oven 14.

The bottom panel 40 of the inner liner 32 defines the lower and rear extent of the heating chamber. The bottom panel 40 includes a main or lower wall 46 from which a substantially-vertical front flange 48 and a substantially-vertical rear wall 50 extend. The lower wall 46 has openings along its lateral edges through which screws are inserted to secure the bottom panel 40 to the side panels 42, 44 and portions of the outer enclosure 34 as further described hereafter. The lower wall 46 also has upwardly embossed openings through which screws are inserted to secure the heating element 36 to the bottom panel 40 as further described hereafter. The front flange 48 is bent generally perpendicular to the lower wall 46 from a front edge of the lower wall 46. The front flange 48 has openings through which screws are inserted to secure the bottom panel 40 to a portion of the outer enclosure 34 as further described hereafter. The rear wall 50 is bent generally perpendicular to the lower wall 46 from a rear edge of the lower wall 46. An upper flange 52 is bent generally perpendicular the rear wall 50 and forwardly extends from a top edge of the rear wall 50. A pair of mounting tabs 54 are also bent generally perpendicular to the rear wall 50 and rearwardly extend from the lateral side edges of the rear wall 50. The tabs 54 have openings through which screws are inserted to secure the bottom panel 40 to side panels 42, 44. The rear wall 50 also has openings and extruded holes for mounting the heating element 36 and the temperature sensing assembly 38 as described in more detail hereafter.

The side panels 42, 44 of the inner liner 32 define the lateral extent of the heating chamber. Each side panel 42, 44 includes a main or lateral wall 56 from which substantially-horizontal upper and lower flanges 58, 60 inwardly extend and substantially-vertical end walls 62, 64 outwardly extend. The lateral wall 56 has an opening through which a screw is inserted to secure the side panel 42, 44 to the mounting tab 54 of the bottom panel 40 as described hereinbefore The lateral wall 56 also has openings formed therein for attaching the glide assemblies 24. Each of the side panels 42, 44 has a first portion of the glide assemblies 24 secured thereto, as will be discussed in more detail hereafter. The lateral wall 56 of the left side panel 42 also has an opening sized for passing wires therethrough near a rear end of the lateral wall 56. The upper and lower flanges 58, 60 are bent generally perpendicular to the lateral wall 56 from the top and bottom edges of the lateral wall 56 respectively. The lower flange 60 has openings through which screws are inserted to secure side panel 42, 44 to the lower wall 46 of the bottom panel 40 as described hereinbefore. The end walls 62, 64 are bent generally perpendicular to the lateral wall 56 from the front and rear edges of the lateral wall 56. Flanges 66, 68 are bent generally perpendicular to the end walls 62, 64 and extend from the outer edge of the end walls 62, 64 generally parallel to the lateral wall 56. The flanges 66, 68 have openings through which screws are inserted to secure the side panels 42 to the outer enclosure 34 as further described hereafter. The front end wall 62 of the left side panel 42 forms the control panel 26 and has openings and holes for mounting the heater control switch 28 and the indicator light 30.

The outer enclosure 34 includes left and right lateral walls or panels 70, 72, a rear wall or panel 74, a top wall or panel 76, and front trim 78. The lateral panels 70, 72, rear panel 74, and the top panel 76 are preferably formed from steel. The front trim 78 is preferably formed from stainless steel which is polished at exposed surfaces.

The lateral panels 70, 72 of the outer enclosure 34 define the lateral extent of the outer enclosure 34. The lateral panels 70, 72 each have a substantially-horizontal base or lower wall 80 from which a substantially-vertical side or outer wall 82 and a substantially-vertical inner wall 84 upwardly extend. The outer wall 82 is bent generally perpendicular to the lower wall 80 from an outer edge of the lower wall 80. The outer wall 82 has openings through which screws are inserted to secure the lateral panels 70, 72 of the outer enclosure 34 to the side walls 42, 44 of the inner liner 32. The inner wall 84 is bent generally perpendicular to the lower wall 80 from an inner edge of the lower wall 80. A substantially-horizontal flange 86 is bent generally perpendicular to the inner wall 84 and inwardly extends from a top edge of the inner wall 84. Mounting tabs 88 are formed in the flange 86 to secure and support the inner liner 32. The tabs 88 have openings through which screws are inserted to secure the bottom panel 40 and the side panels 42, 44 of the inner liner 32 to the lateral panels 70, 72 of the outer enclosure 34.

The left lateral panel 70 of the outer enclosure 34 has a rectangularly-shaped access opening at a forward end thereof. The access opening provides access to the rear side of the heater control switch 28 and the indicator light 30 mounted on the control panel 26. A removable door 89 is provided to selectively close and open the access opening. The door 89 preferably has a mounting tab at one side for a screw which is inserted into an opening in the lateral panel 70 adjacent the access opening and a pair of mounting tabs at the opposite side which are inserted into slots in the lateral panel 70 adjacent the access opening.

The rear panel 74 of the outer enclosure 34 defines the rear extent of the outer enclosure 34. The rear panel 74 has a substantially-vertical back wall 90 from which a substantially-horizontal bottom wall 92 inwardly extends. The bottom wall 92 is bent generally perpendicular to the back wall 90 from a lower edge of the back wall 90. The back wall 90 has openings through which screws are inserted to secure the rear panel 74 to the top panel 76. The back wall 90 also has an opening for passage of a power cord (not specifically shown) therethrough. Flanges 94 are bent generally perpendicular to the back wall 90 and forwardly extend from the side edges of the back wall 90. The bottom wall 92 is bent generally perpendicular to the back wall 90 from the lower edge of the back wall 90. Flanges 96, 98 are bent generally perpendicular to the bottom wall 92 and upwardly extend from the forward and side edges of the bottom wall 92 respectively. The flanges 94, 96, 98 of the back and bottom walls 90, 92 cooperate with the bottom and side panels 40, 42, 44 of the inner liner 32.

The top panel 76 of the outer enclosure 34 defines the upper extent of both the outer enclosure 34 and the heating chamber. The top panel 76 includes a generally planar upper wall 100 from which a forward flange 102, a rearward flange 104, and a pair of lateral flanges 106 are downwardly bent. The rearward flange 104 includes openings through which screws are inserted to secure the top panel 76 to the rear panel 74 as discussed hereinbefore. The lateral flanges 106 include openings through which screws are inserted to secure the top panel 76 to the lateral walls 70, 72 as discussed hereinbefore.

As best shown in FIGS. 2 and 3, the panels 40, 42, 44 of the inner liner 32 cooperate with the panels 70, 72, 74, 76 of the outer enclosure 34 to define the heating chamber. The heating chamber is closed at its lateral sides by the side panels 42, 44 of the inner liner 32, its rear side by the bottom panel 40 of the inner liner 32, its upper side by the top panel 76 of the outer enclosure, and its lower side by the bottom panel 40 of the inner liner 32. The heating chamber is open at its front side which forms a front opening 108 adjacent the control panel 26.

The side panels 42, 44 of the inner liner 32 are laterally spaced from and are substantially parallel to the lateral panels 70, 72 of the outer enclosure 34 to form side spaces or chambers. The side chambers extend the full longitudinal length of the outer enclosure 34 and space the heating chamber from the lateral sides of the outer enclosure 34. The rear wall 50 of the inner liner bottom panel 40 is rearwardly spaced from and is substantially parallel to the rear panel 74 of the outer enclose 34 to form a rear space or chamber. The rear chamber forwardly spaces the heating chamber from the rear end of the outer enclosure 34.

The trim 78 of the outer enclosure 34 forms a frame about the front opening 108 and the control panel 26 of the warmer drawer chassis 20. The trim 78 cooperates with the warmer drawer 22 to form a generally smooth front surface when the warmer drawer 22 is fully within the heating chamber (as best shown in FIG. 1). The trim 78 includes a bottom trim member 110, left and right side trim members 112, 114, and a top trim member 116.

The bottom trim member 110 has a main wall bent to generally form a rectangularly-shaped cross section having end flanges 120 upwardly extending from the ends thereof and an upper flange 122 upwardly extending from an upper rear edge thereof. The upper flange 122 has openings through which screws are inserted to secure the bottom trim member 110 to the front flange 48 of the inner liner bottom panel 40 as described hereinbefore.

The bottom ends of the lower trim member 110 have openings through which screws are inserted to secure the bottom trim member 110 to the side trim members 112, 114 as further described hereinbelow.

The side trim members 112, 114 each have a main wall 124 bent to generally form a rectangularly-shaped cross section having end flanges 126 outwardly extending from the ends thereof and a side flange 128 rearwardly extending from an inner rear edge thereof. The end flanges 126 have openings through which screws are inserted to secure the side trim members 112, 114 to the bottom and top trim members 110, 116. The side flange 128 has openings through which screws are inserted to secure the side trim members to the forward flange 66 of the inner liner side panels 42, 44 as described hereinbefore.

The top trim member 116 has a main wall 130 bent to generally form a rectangularly-shaped cross section and end flanges 132 downwardly extending from the ends of the main wall 130. The bottom ends of the main wall 130 have openings through which screws are inserted to secure the top trim member 116 to the end flanges 126 of the side trim members 112, 114 as described hereinbefore.

Figure 5:
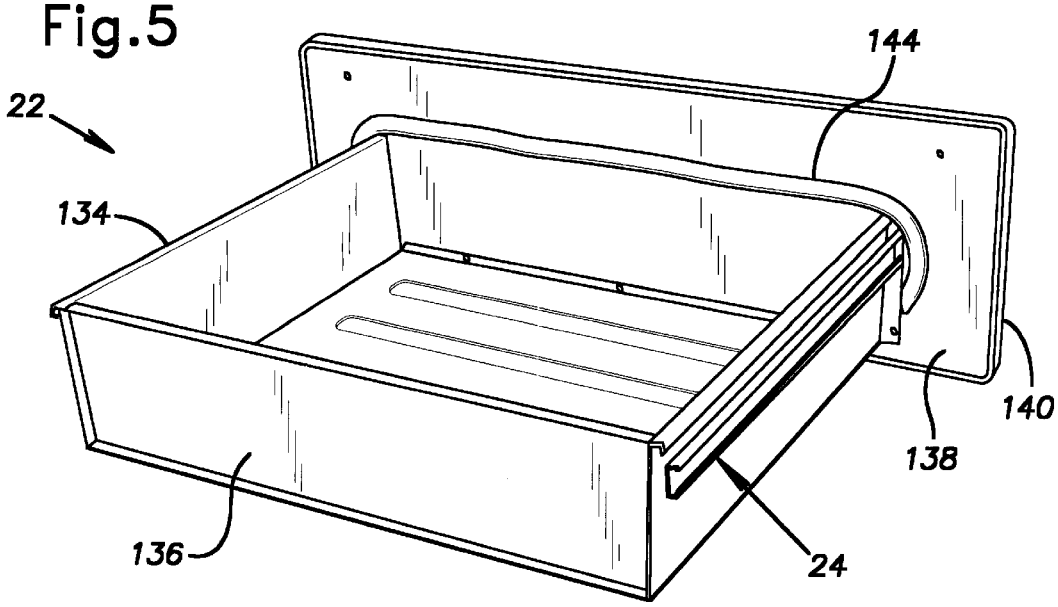
FIG. 5 is a rear perspective view of the drawer of the warming appliance of FIG. 1.
Figure 6:
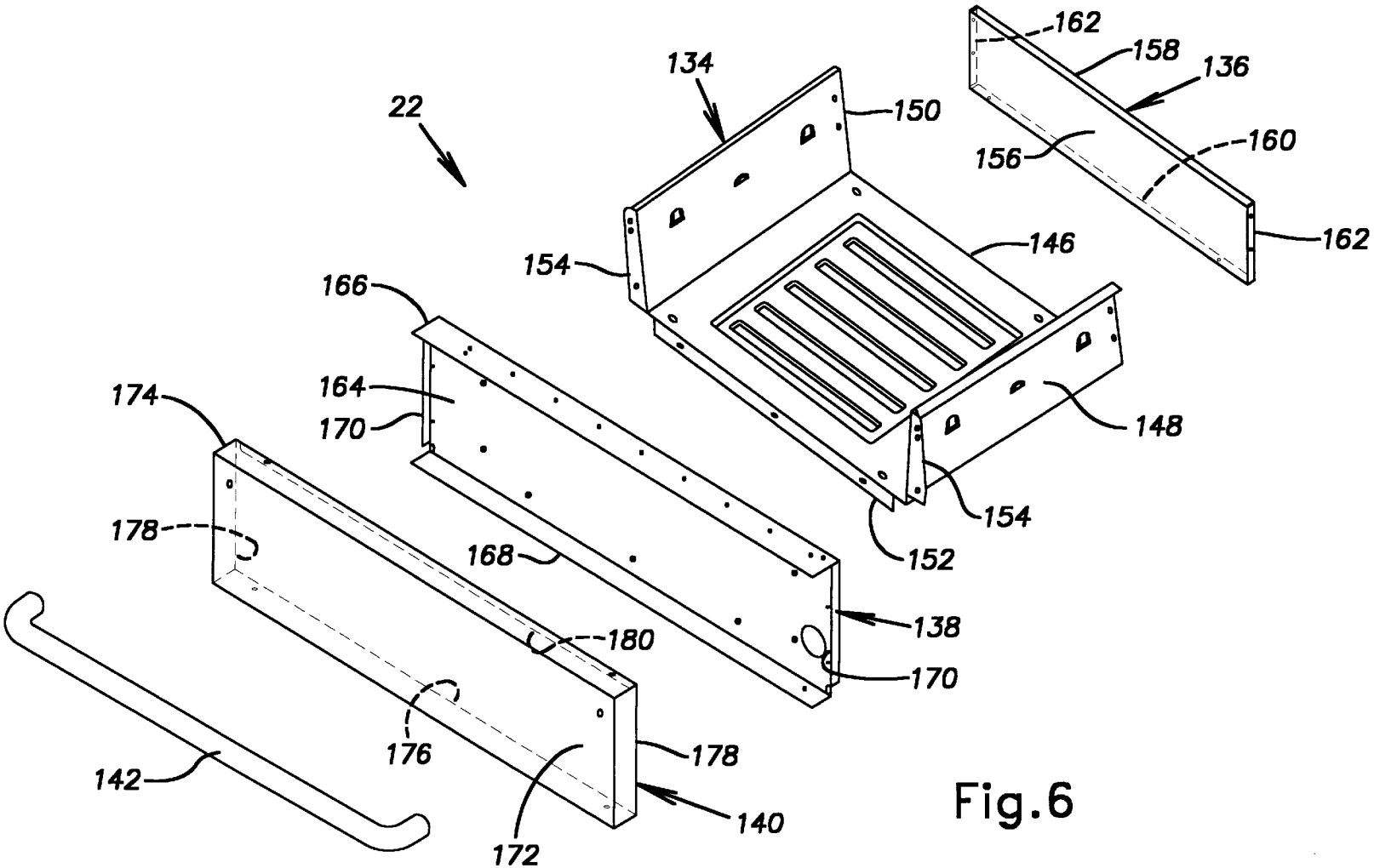
FIG. 6 is an exploded view of the drawer of the warming appliance of FIG. 1.

As best shown in FIGS. 5 and 6, the warmer drawer 22 has forward, rearward, lateral an lower walls which define a receptacle adapted to receive food stuffs to be maintained at an acceptable above-ambient serving temperature. The warmer drawer 22 preferably receives one or more racks (not specifically shown) which support food stuffs in a spaced relationship to the lower wall. The warmer drawer 22 includes a main panel 134 which forms the lower and lateral walls, a back panel 136 which forms the rearward wall, interior and exterior front panels 138, 140 which together form the forward wall, a pull handle 142, and a heat sealing member or gasket 144. The main panel 134, the back panel 136, and the interior front panel 138 of the warmer drawer 22 are preferably formed from steel with porcelain on exposed surfaces. The exterior front panel 140 and the pull handle 142 are preferably formed from stainless steel which is polished at exposed surfaces.

The main panel 134 of the warmer drawer 22 defines the lower and lateral extent of the warmer drawer receptacle and includes a lower wall 146 and lateral walls 148, 150 which upwardly and outwardly extend from the side edges of the lower wall 146. The lower and lateral walls 146, 148, 150 include openings through which screws are inserted to secure the main panel 134 to the back panel 136 as further discussed hereafter. A front flange 152 is downwardly bent from the front edge of the lower wall 146. The front flange 152 includes openings through which screws are inserted to secure the main panel 134 to the interior front panel 138 as further discussed hereafter. Side flanges 154 are outwardly bent from the front edges of the lateral walls 148. The side flanges 154 include openings through which screws are inserted to secure the main panel 134 to the interior front panel 138 as further discussed hereafter. Openings are formed in the lateral walls 148 to secure the glide assemblies 24. Each of the lateral walls 148 has a second portion of the glide assembly 24 secured thereto, as will be discussed in more detail hereafter.

The back panel 136 of the warmer drawer 22 defines the rearward extent of the warmer drawer receptacle. The back panel 136 includes a generally planar main wall 156 from which a top flange 158, a bottom flange 160, and a pair of lateral flanges 162 are rearwardly bent. The bottom and lateral flanges 160, 162 include openings through which screws are inserted to secure the back panel 136 to the main panel lower wall 146 and the main panel lateral walls 148, 150 respectively, as discussed hereinbefore.

The interior front panel 138 of the warmer drawer 22 includes a generally planar main wall 164 from which a top flange 166, a bottom flange 168, and a pair of lateral flanges 170 are forwardly bent. The main wall 164 includes openings through which screws are inserted to secure the interior front panel 138 to the main panel front and side flanges 153, 154 as discussed hereinbefore. The main wall 164 also includes openings through which screws are inserted to secure a heat sealing member 144 and the exterior front panel 140 respectively. The bottom flange 168 also includes openings through which screws are inserted to secure the interior front panel 138 to the exterior front panel 140 as discussed hereafter.

The exterior front panel 140 of the warmer drawer 22 includes a generally planar main wall 172 from which a top flange 174, a bottom flange 176, and a pair of lateral flanges 178 are forwardly bent. The adjacent ends of the flanges 174, 176, 178 are preferably welded together at the corners of the exterior front panel 140. The bottom flange 176 includes openings through which screws are inserted to secure the exterior front panel 140 to the interior front panel bottom flange 168 as discussed hereinbefore. The top flange 174 also has a rear flange 180 downwardly bent therefrom at a rear edge. The rear flange 180 includes openings through which screws are inserted to secure the exterior front panel 140 to the interior front panel main wall 164 as discussed hereinbefore. The main wall 172 includes openings through which screws are inserted to secure the pull handle 142 to the exterior front panel 140.

The annular heat sealing member 144 of the warmer drawer 22 is attached to a rearward facing surface of the interior front panel 138 and encircles the main panel 134, as illustrated. When the warmer drawer 22 is in a retracted or closed position, the heat sealing member 144 engages the warmer drawer chassis 22 about the front opening 108 to limit the escape of heat from within the warmer drawer 22 and the heating chamber. Preferably the heat sealing member 144 is formed from a material commonly used to seal the periphery of an oven door to the cabinet.

Figure 7:
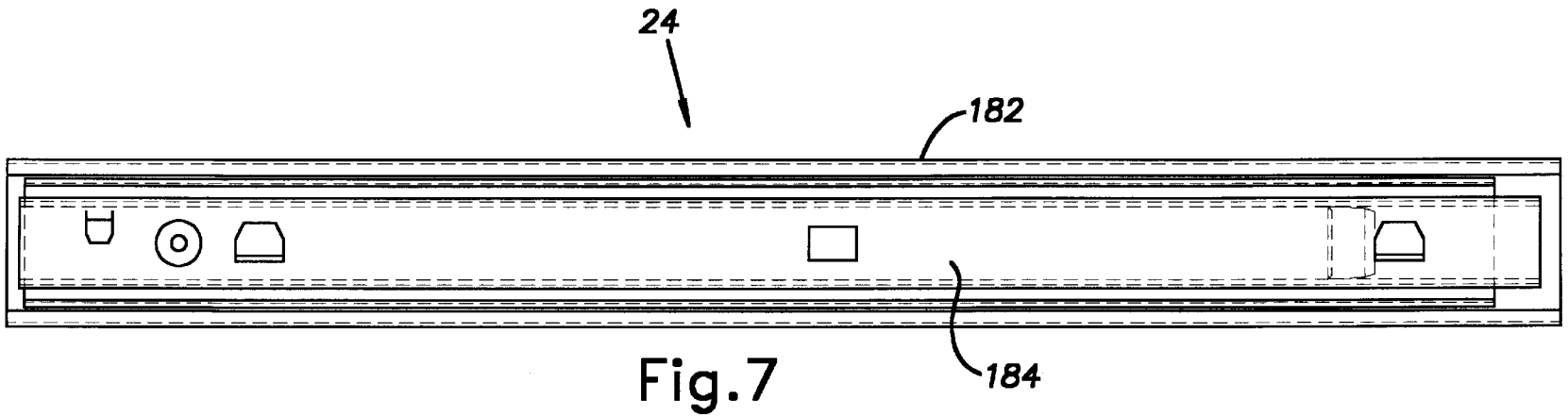
FIG. 7 is a side elevational view of a glide assembly of the warming appliance of FIG. 1.
Figure 8:
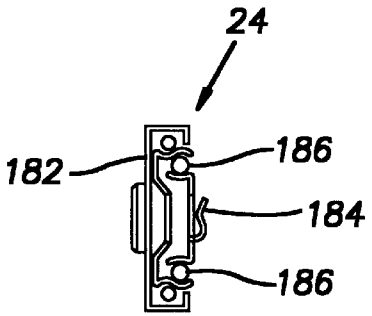
FIG. 8 is a cross-sectional view taken along line 8—8 of FIG. 7.

The warmer drawer 22 is slidably inserted into the heating chamber, by means of the glide assemblies 24. As best shown in FIGS. 7 and 8, the glide assemblies 24 each include a first or outer portion 182, a second or inner portion 184 which is longitudinally received within the outer portion 182, and a plurality of bearing members 186 located between the outer and inner portions 182, 184. The outer portion 182 of the drawer glide assembly 24 is secured to the inner surface of the inner liner side panels 42, 44 (best shown in FIG. 3). The inner portion 184 of the glide assembly 24 is secured to the outer surface of the warmer drawer main panel 134 (best shown in FIG. 5). The first and second portions 182, 184 of the glide assembly 24 cooperate with one another to permit the warmer drawer 22 to be slidably inserted into the heating chamber and slidably removed from the heating chamber. Also, the first and second glide portions 182, 184 may be disengaged from one another to permit the warmer drawer 22 to be completely disconnected and removed from the heating chamber. It is understood that numerous glide assemblies 24 are known in the art, and various other glide assemblies may be substituted for the illustrated glide assembly 24 without departing from the scope and spirit of the present invention.

Figure 9:
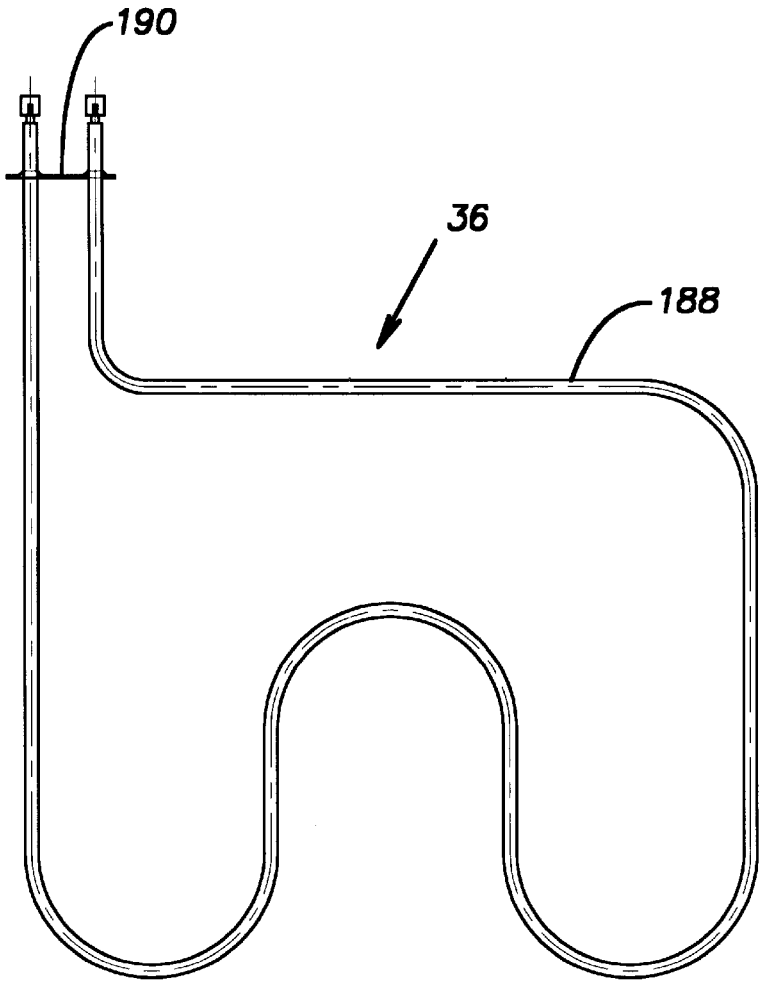
FIG. 9 is a top plan view of a heating element of the warming appliance of FIG. 1.

As best shown in FIG. 3, the heating element 36 and temperature sensing assembly 38 are each disposed within the heating chamber and secured to the bottom panel 40 of the inner liner 32. As best shown in FIG. 9, the heating element 36 preferably includes a tubular, electrical resistance-type heating element 188 which is fastened to the lower panel rear wall 50 via a mounting plate 190 and to the lower panel lower wall 46 via three mounting clips 192. The mounting plate 190 of the heating element 36 preferably has openings through which fasteners extend to secure the mounting plate to the lower panel rear wall 50.

Figure 10:
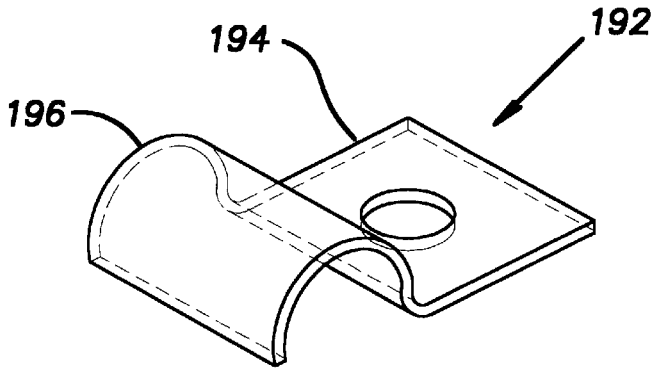
FIG. 10 is a perspective view of a heating element mounting clip of the warming appliance of FIG. 1.

As best shown in FIG. 10, the mounting clips 192 each have a planar mounting portion 194 and an arcuate clamping portion 196 formed to cooperate with the tubular heating element 36. The mounting portion 194 includes an opening through which a screw is inserted to secure the mounting clip 192 to the lower wall 46 of the inner liner bottom panel 40 as described hereinbefore. With the mounting portion 194 secured to the lower wall 46, the clamping portion clamps the heating element 36 to the lower wall 46. Naturally, greater or less quantity of the mounting clips 192 may be used to secure the heating element 36 to the bottom panel 440 if desired.

Figure 12:
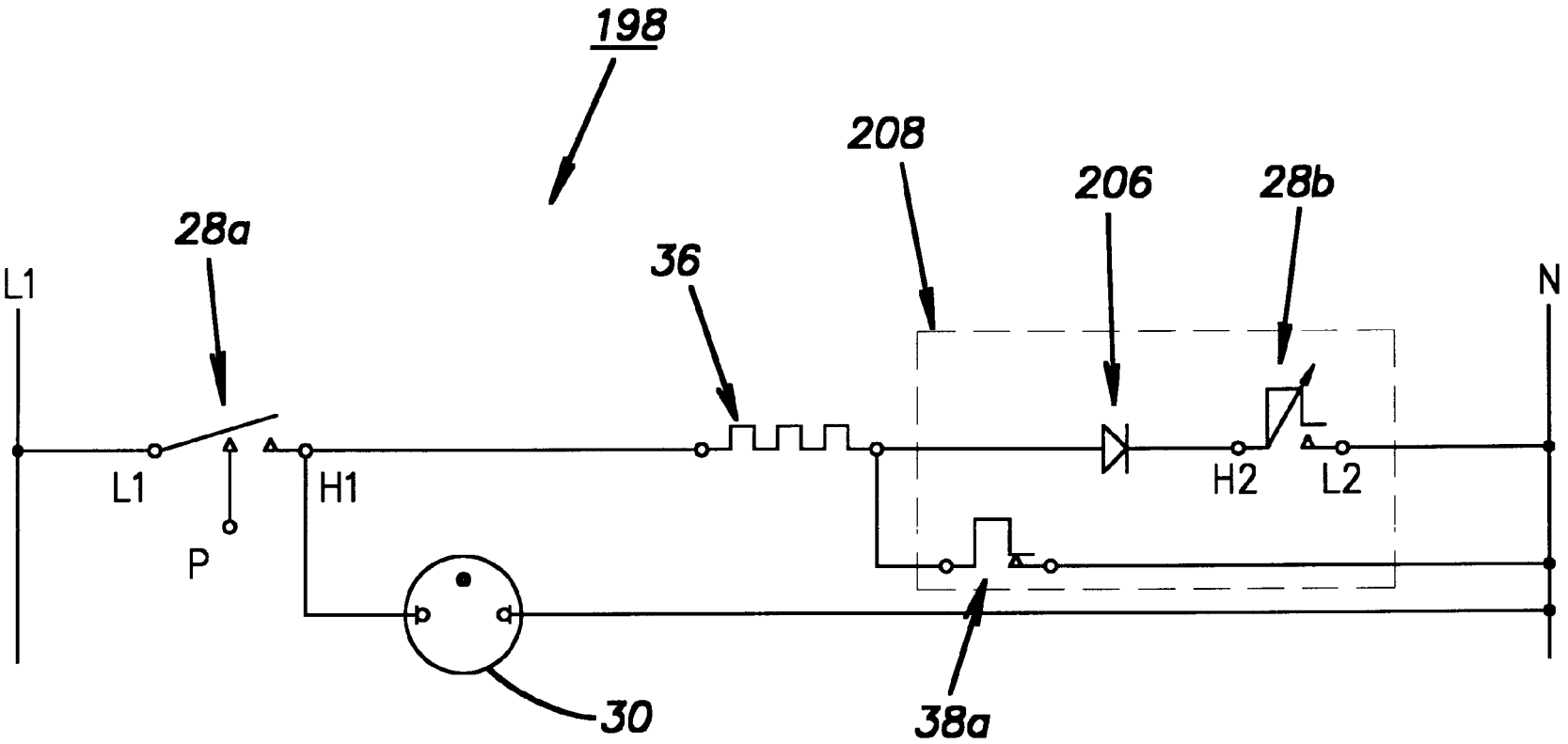
FIG. 12 is a schematic diagram illustrating a control circuit for the warming appliance of FIG. 1.
Figure 13C:
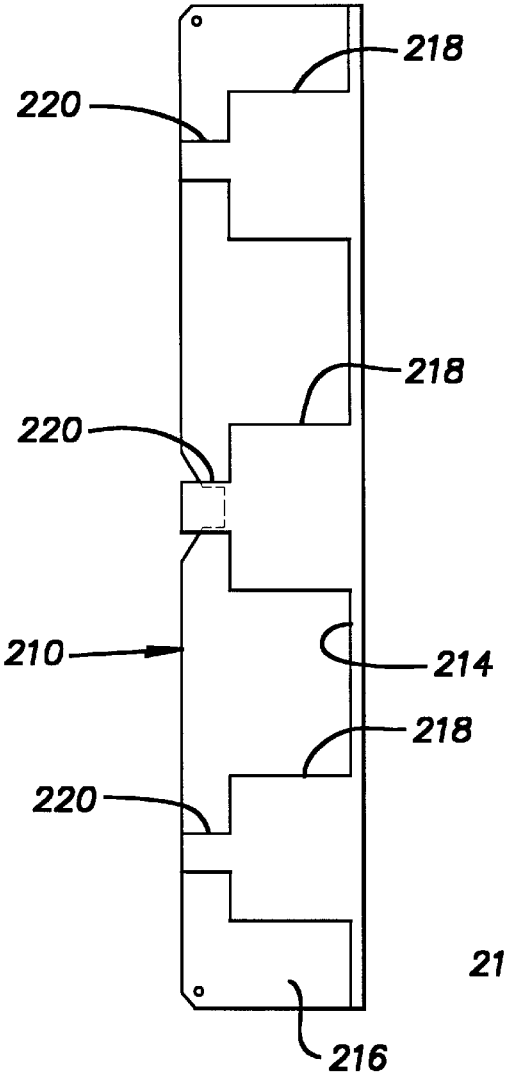
FIGS. 13*a,* 13*b,* and 13*c* are, respectively, a front elevational view, a top plan view, and a side elevational view of an oven support member of the warming appliance of FIG. 1.
Figure 13B:
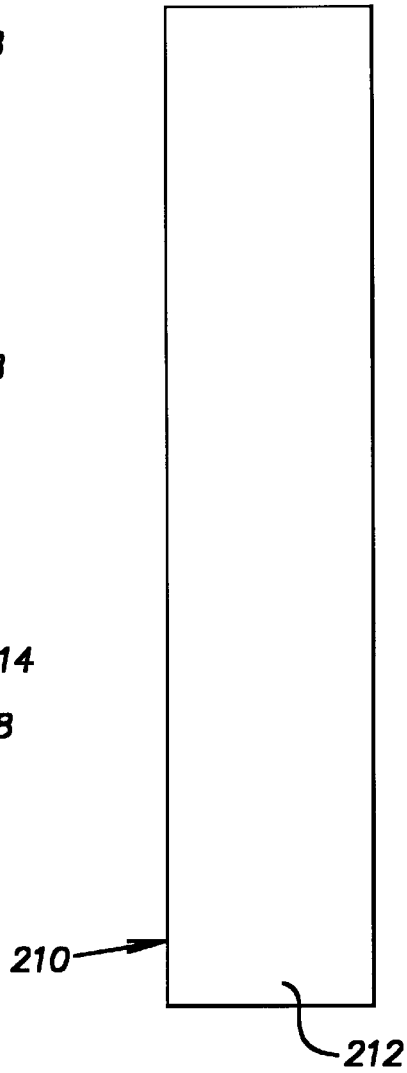
Figure 13A:
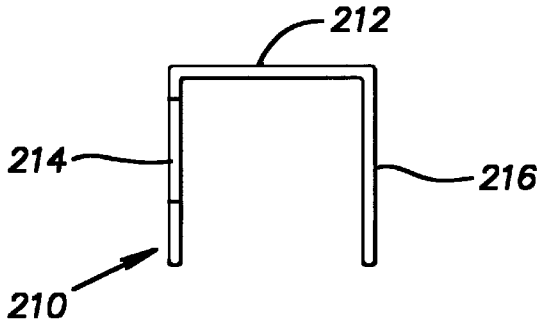

The heating element 36 is electrically connected to the temperature sensing assembly 38, and is powered in accordance with the user-selected setting of the control switch 28 and as-needed to maintain the temperature within the heating chamber, as sensed by the temperature sensing assembly 38, within a predetermined desired range of operating temperatures, as will be described in more detail hereafter with reference to a control circuit 198 (FIG. 12).

Figure 11A:
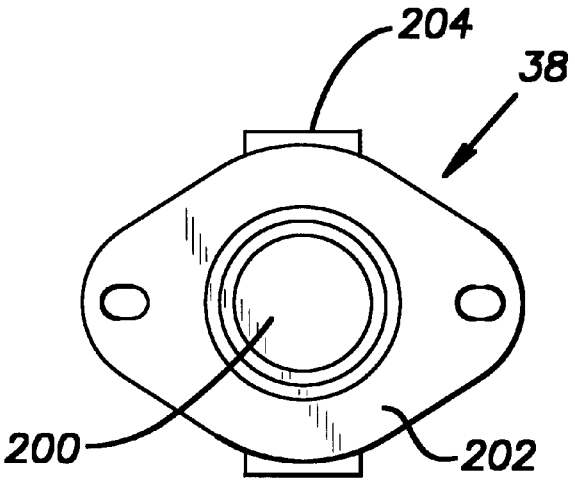
FIGS. 11*a,* 11*b,* and 11*c* are, respectively, a front elevational view, a top plan view, and a side elevational view of a temperature sensor of the warming appliance of FIG. 1.
Figure 11C:
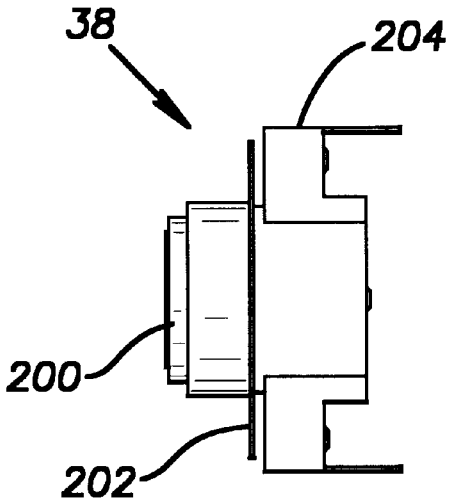
Figure 11B:
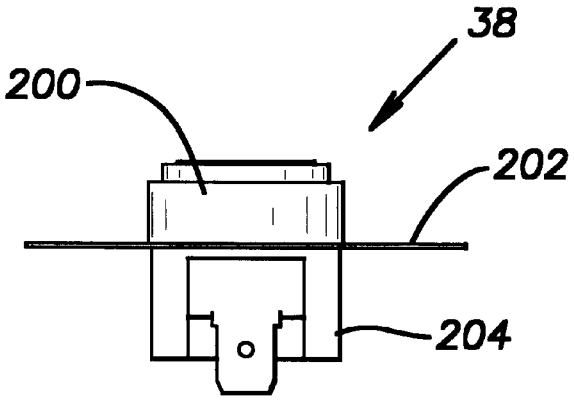

As best shown in FIGS. 11*a*–11*c*, the temperature sensing assembly or temperature sensor 38 has a forwardly projecting sensor portion 200, a mounting flange 202, and a rearwardly extending connector portion 204. The mounting flange 202 includes a pair of lateral openings through which fasteners extend to secure the temperature sensor 38 to the bottom panel rear wall 50. The temperature sensor 38 is inserted through the elongated opening in the bottom panel rear wall 50, such that the sensor portion 200 faces toward the warmer drawer 22 and the front opening 108 of the heating chamber and the connecting portion 204 faces toward the bottom panel rear wall 50. The connecting portion 204 is electrically connected, via suitable conductors, to the control switch 28 and the heating element 36. It is noted that wires conveniently extend through the rear chamber and the left side chamber formed between the inner liner 32 and the outer enclosure 34.

The temperature sensor 38 is secured to the bottom panel rear wall 50 in an elevated position, as illustrated in FIG. 3, and is operable to sense the temperature within the heating chamber. Therefore, the sensor 38 is located at the rear of the heating chamber behind the warmer drawer and at the top of the heating chamber adjacent the top panel 76. The location of the sensor 38 gives the control circuit 198 its ambient compensation characteristics. For example, and as will be apparent from the description to follow, relatively more heat may have to be input into the heating chamber to reach the predetermined maximum temperature during low ambient conditions than during high ambient conditions. Putting more heat into the heating chamber during low ambient conditions may help reduce cycling as the time required to reach the minimum temperature will be extended. Moreover, the temperature within the warmer drawer 22 corresponding to the predetermined maximum heating chamber temperature may be relatively higher during low ambient conditions than during high ambient conditions. For high ambient conditions, less heat may be required to reach the predetermined maximum heating chamber temperature, and less heat is lost to atmosphere, so the temperature within the heating chamber and the warmer drawer 22 may be relatively more uniform and static.

The warmer drawer 22 of the present invention is located above the heating element 36 and, therefore, takes advantage of the natural tendency of relatively hot air to rise. As such, the food stuffs contained within the warmer drawer 22 are in a relatively hot portion of the heating chamber. As mentioned briefly hereinbefore, it may be desirable to place one or more removable racks within the warmer drawer 22 to space the food stuffs being warmed away from the lower wall 146 of the warmer drawer 22. Spacing the food stuffs from the lower wall 146 permits warm air to flow beneath the food stuffs and facilitates more even heating thereof. Spacing of the food stuffs away from the lower wall 146 also prevents localized over-heating of the food stuffs at the interface with the warmer drawer main panel 134, since the main panel 134 will be relatively hot, as compared to air within the heating chamber, due to the proximity of the main panel 134 to the heating element 36.

FIG. 12 illustrates the preferred control circuit 198 for the warmer drawer heating element 36. The control circuit 198 generally includes the heater control switch 28, the indicator light 30, heating element 36, the temperature sensor 38, and a diode 206. The heater control switch 28 provides first and second pairs of contacts 28*a*, 28*b*. The first pair of contacts 28*a* are closed whenever the switch 28 is turned on. The second pair of contacts 28*b* open and close when the switch 28 is turned on, the frequency of opening and closing depending upon the angular position of the switch 28 to vary or adjust the duty cycle of heater operation. For example, when the heater control switch 28 is turned to "high", the second pair of contacts 28*b* are mechanically locked in a closed position whereas, when the switch 28 is turned to the "low" position, the second pair of contacts 28*b* will be closed only a portion of the time. It is considered that the above-described operation of the switch 28 is well known in the infinite switch art.

The first pair of heater control switch contacts 28*a* are connected in series with the heating element 36. The warmer indicator light 30 is connected in parallel with the warmer heating element 36 and a heating element energization control circuit 208 and, therefore, is illuminated whenever the heating element 36 is powered to provide visual indication to the user that the warmer heating element 36 is operating.

The temperature sensor 38 provides a thermally-actuated switch 38*a* which is normally closed. The energization control circuit 208 includes the diode 206 and the second pair of heater control switch contacts 28*b* in parallel with the temperature sensor switch 38*a*, as illustrated. Therefore, when the heater control switch 28 is turned from "off" to any position, the series combination of the second pair of heater control switch contacts 28*b* and the diode 206 is shorted by the parallel branch due to the normally-closed temperature sensor switch 38*a*.

The heating element 36 is therefor in series with the temperature sensor switch 38*a*, and full power is applied to the heating element 36. At this point, no current flows through the branch of the energization circuit 208 containing the diode 206 and the second pair of heater control switch contacts 28*b*. This period of operation is referred to herein as the preheating cycle during which the heating element 36 is operated at full power to more quickly bring the warmer drawer 22 up to the maximum operating or preheat temperature. When the temperature within the heating chamber reaches the predetermined maximum desired temperature or peak preheat temperature, the temperature sensor switch 38*a* opens and control of the heating element 36 energization is given over to the heater control switch 28. The time required to reach the predetermined maximum temperature depends upon a number of factors, including the size, temperature, and type of food being warmed, and the ambient temperature.

The heating chamber temperature corresponds to the warmer drawer temperature, i.e. food temperature, so that sensing of the heating element temperature and, as will be apparent from the following description, the sensed heating chamber temperature is used to control energization of the heating element 36 to maintain the warmer drawer temperature within a range of desired food serving temperatures.

Due to the diode 208, only half-wave rectified current flows through the heating element 36 which, therefore, is limited to half maximum power if the control switch 28 is set to "high". As noted hereinbefore, the duty cycle of the heating element 36 operation is controlled by the angular position of the heater control switch 28 which, in turn, corresponds to the rate or frequency of opening/closing of the second pair of heater control switch contacts 28*b*.

The duty cycle controls the amount of power dissipated in the heater element 36 which, in turn, affects the amount of heat energy added to the heating chamber and, hence, the warmer drawer 22. The rate at which the heating chamber temperature falls (from the maximum temperature at the end of the preheat cycle) is affected by the food load within the warmer drawer 22, the ambient temperature, and the user-selected duty cycle of the warmer drawer heating element 36, i.e. the angular position of the control switch 28.

For example, at a given ambient temperature, if a relatively large, cool item of food is placed in the warmer drawer 22 and the control switch 28 is set to the "low" position (which corresponds to a small duty cycle, e.g., 0.20) the temperature within the heating chamber and the drawer 22, following the preheat cycle, will fall faster than if a similarly sized but hotter item of food is placed in the drawer 22 and the control switch 28 is set to "high" (i.e., full one-half power, switch duty cycle equals 1.0). Similarly, if a small, hot food item is placed in the drawer 22 in a low ambient environment and the control switch 28 is set to "medium", the temperature within the heating chamber and the drawer 22 will fall faster than if an item of similar size and temperature is placed in the warmer drawer 22 in a high ambient environment and the control switch 28 is set to the "medium" position.

If the heating chamber temperature drops below a predetermined minimum desired temperature, which corresponds to a minimum desired serving temperature within the drawer 22, the temperature sensor contacts 38*a* close, shorting the branch of the energization circuit 208 containing the diode 206 and the second pair of heater control switch contacts 28*b*, and full power is again applied to the heating element 36 until the heating chamber temperature exceeds the maximum desired temperature, corresponding to the maximum desired serving temperature within the drawer 22, at which point the temperature sensor contacts 38*a* open and control is returned to the heater control switch 28 at the user-selected duty cycle. Accordingly, the warmer drawer temperature is maintained between maximum and minimum desired serving temperatures.

As should be apparent from the foregoing, control over energization of the heating element 36 alternates between full power when the temperature sensor contacts 38*a* close (preheat cycle and low heating chamber/drawer temperature) and the user selected duty cycle. As noted hereinbefore, the heat input into the heating chamber to reach the maximum desired heating chamber temperature will vary depending at least upon ambient temperature. Similarly, the rate at which the heating chamber temperature falls to the predetermined minimum desired heating chamber temperature will vary at least depending upon ambient temperature, food size and type, and user selected setting of the control switch 28.

It is noted that the maximum and minimum warmer drawer temperatures may vary in dependance upon ambient temperature. For example, the maximum warmer drawer temperature may be relatively higher in low ambient conditions than in high ambient conditions. Similarly, the minimum warmer drawer temperature may be relatively higher in low ambient conditions than in high ambient conditions. Since relatively more heat is lost to the environment in low ambient conditions than in high ambient conditions, the noted temperature compensation feature reduces cycling of the heater element between the user-selected duty cycle and the full-power cycle than would otherwise occur. The maximum an minimum warmer drawer temperatures fall within a range of desired food serving temperatures.

As best shown in FIG. 2, 13*a*–13*c*, and 14, the free-standing warming appliance 10 can optionally be provided with a pair of oven support members 210 to directly support the built-in oven 14. Each of the oven support members 210 is inverted-U-shaped in cross section having a top wall 212 and inner and outer walls 214, 216 downwardly bent from the inner and outer edges if the top wall 212. The inner wall forms a plurality of spaced-apart engagement arms 218 with mounting tabs 220 provided at their lower ends. The tabs 220 are sized to be inserted into a plurality of spaced-apart and collinear slots 222 formed in the top panel 76 (best shown in FIG. 4). The outer wall 214 is provided with openings and a central groove through which the screws are inserted which secure the top panel 76 to the lateral panels 70, 72.

Each support member 210 is attached to the warmer drawer chassis 20 by inserting the tabs 220 into the slots 222 in the outer enclosure top panel 76 so that the arms 218 engage the top panel 76. Screws are then inserted to attach the outer wall 216 to the outer enclosure lateral walls 70, 72. It is readily apparent from the above description that the support members 210 can be installed and removed with access to only the lateral sides of the warming appliance 10.

Figure 14:
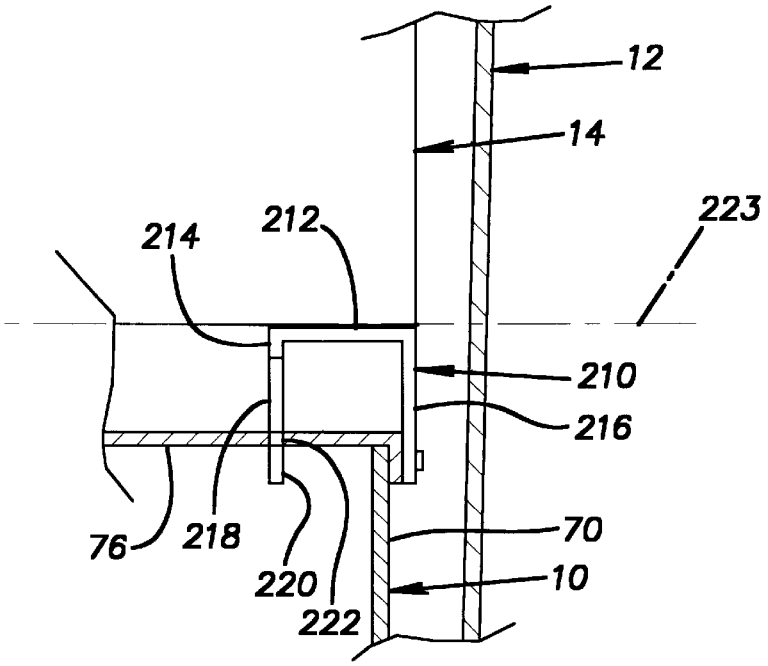
FIG. 14 is a fragmentary elevational view, in cross section, showing the warming appliance of FIG. 1 supporting the built-in oven.

With each of the support members 210 attached to the outer enclosure 34 of the warming appliance 10, the top walls 210 of the support members 210 are generally parallel and spaced-apart to form a generally horizontal support plane 223 for the built-in oven 14. As best shown in FIG. 14, the oven 14 rests directly on the support member top walls 212 within the cabinet 12. Therefore, the free-standing warming appliance 10 directly supports the built-in oven 14.

Figure 15:
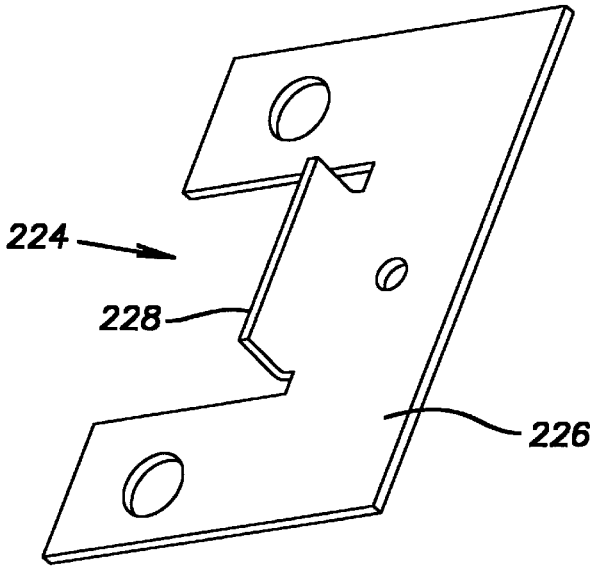
FIG. 15 is a perspective view of a support bracket of the warming appliance of FIG. 1.

As best shown in FIGS. 1 and 15, the free-standing warming appliance 10 can optionally be provided with a pair of cabinet support brackets 224. Each bracket has a generally planar main wall 226 and a tab 228 extending generally perpendicularly therefrom. The main wall 226 is provided with openings through which screws are inserted to secure the support brackets to the lateral panels 70, 72 of the outer enclosure 34. With the brackets 224 attached to the outer enclosure 34 with the tabs 228 laterally extending outward from the sides of the outer enclosure 34. The tabs 228 are generally parallel to the front surface of the warming appliance 10 and spaced rearwardly from the rear side of the front trim 78 a distance adequate to receive the front panel of the cabinet therebetween 12. The tabs 228 provide forward facing engagement surfaces which engage the rear surface of the cabinet front panel to prevent the chassis 20 of the warming appliance 10 from being pulled out of the cabinet 12 when the warmer drawer 22 is pulled out of the chassis 20.

Although particular embodiments of the invention have been described in detail, it is to be understood that the invention is not limited correspondingly in scope, but includes all changes and modifications coming within the spirit and terms of the claims appended hereto.

What is claimed is:

1. A free-standing warming appliance comprising:

an enclosure having a pair of lateral walls and a top wall disposed between said lateral walls:

a liner having a pair of lateral walls inwardly spaced from said enclosure lateral walls and a bottom wall disposed between said liner lateral walls, wherein said enclosure top wall, said liner lateral walls, and said liner bottom wall cooperate to form a heating chamber;

a panel extending between one of said enclosure lateral walls and one of said liner lateral walls;

a warmer drawer adaoted to be received within and withdrawn from said heating chamber, said warmer drawer including a front wall, a rear wall, a pair of lateral walls, and a bottom wall, which define a receptacle adapted to receive food stuffs, said front wall extending between said enclosure lateral walls and in front of said panel such that access to said panel is provided only when said warmer drawer is withdrawn from said heating chamber;

a heating element secured to said liner within said heating chamber at a location relatively beneath said warmer drawer; and, oven support members secured to said enclosure.

2. The warming appliance according to claim 1, wherein said oven support members have engagement surfaces which together form a generally horizontal support plane above said enclosure top wall.

3. The warming appliance according to claim 1, wherein said support members are generally inverted-U-shaped in cross section having a top wall and inner and outer walls downwardly extending from inner and outer edges of said top wall.

4. The warming appliance according to claim 3, wherein said inner walls are secured to said enclosure outer walls with fasteners and said inner walls engage said enclosure top wall.

5. The warming appliance according to claim 4, wherein said inner wall is provided with mounting tabs which cooperate with slots formed in said enclosure top wall.

6. The warming appliance according to claim 1, wherein said panel is a control panel.

7. The warning appliance according to claim 6, wherein said control panel includes a control switch and an indicator light.

8. The warming appliance according to claim 6, wherein one of said enclosure lateral walls has an access opening near said control panel and a removable door selectively closing said access opening.

9. A cooking and warming system for a kitchen cabinet comprising:

a warming appliance including an outer enclosure and support members secured to said outer enclosure, said outer enclosure comprising a pair of lateral walls and a top wall disposed between said lateral walls; and a separate cooking appliance located above said warming appliance and resting on said support members, wherein said warming appliance comprises:

a liner having a pair of lateral walls inwardly spaced from said enclosure lateral walls and a bottom wall disposed between said liner lateral walls, wherein said enclosure top wall, said liner lateral walls, and said liner bottom wall cooperate to form a heating chamber, a warmer drawer adapted to be received within and withdrawn from said heating chamber; and a heating element secured to said liner within said heating chamber at a location relatively beneath said warmer drawer.

10. The cooking and warming system according to claim 9, wherein said support members have engagement surfaces which together form a generally horizontal support plane for said cooking appliance, said cooking appliance resting on said engagement surfaces.

11. The cooking and warming system according to claim 9, wherein there are two of said support members which are generally inverted-U-shaped in cross section having a top wall and inner and outer walls downwardly extending from inner and outer edges of said top wall.

12. The cooking and warming system according to claim 11, wherein said outer walls of said support members are secured to said enclosure outer walls with fasteners, and said inner walls of said support members engage said enclosure top wall.

13. The cooking and warming system according to claim 12, wherein said inner walls of said support members are provided with mounting tabs which cooperate with slots formed in said enclosure top wall.

* * * * *

UNITED STATES PATENT AND TRADEMARK OFFICE

CERTIFICATE OF CORRECTION

PATENT NO. : 6,166,353
DATED : December 26, 2000
INVENTOR(S) :

It is certified that error appears in the above-identified patent and that said Letters Patent is hereby corrected as shown below:

On Title Page,
Section [56], References Cited, U.S. PATENT DOCUMENTS, reference 14, delete "1/1962" and insert -- 10/1962 --.
Section [56], References Cited, U.S. PATENT DOCUMENTS, reference 18, delete "3,335,626" and insert -- 3,335,262 --.
Section [56], References Cited, U.S. PATENT DOCUMENTS, Page 2, reference 7, delete "Cothram" and insert -- Cothran --.
Section[56], References Cited, OTHER PUBLICATIONS, reference 2, delete "hppt" and insert -- http --.

Signed and Sealed this

Twenty-fourth Day of July, 2001

*Attest:*

Nicholas P. Godici

NICHOLAS P. GODICI
*Acting Director of the United States Patent and Trademark Office*

*Attesting Officer*